US011571894B2

(12) United States Patent
Tori et al.

(10) Patent No.: US 11,571,894 B2
(45) Date of Patent: Feb. 7, 2023

(54) MULTI-CHIP MODULE (MCM) ASSEMBLY AND A PRINTING BAR

(71) Applicant: SICPA HOLDING SA, Prilly (CH)

(72) Inventors: Silvano Tori, Chiaverano (IT); Tazio Sandri, Verona (IT); Marco Sarti, Turin (IT); Lucia Giovanola, Ivrea (IT)

(73) Assignee: SICPA HOLDING SA, Prilly (CH)

( * ) Notice: Subject to any disclaimer, the term of this patent is extended or adjusted under 35 U.S.C. 154(b) by 31 days.

(21) Appl. No.: 17/265,039

(22) PCT Filed: Jul. 18, 2019

(86) PCT No.: PCT/EP2019/069426
§ 371 (c)(1),
(2) Date: Feb. 1, 2021

(87) PCT Pub. No.: WO2020/025348
PCT Pub. Date: Feb. 6, 2020

(65) Prior Publication Data

US 2021/0379891 A1 Dec. 9, 2021

(30) Foreign Application Priority Data

Jul. 30, 2018 (EP) ..... 18186258

(51) Int. Cl.
*B41J 2/155* (2006.01)
*B41J 2/14* (2006.01)

(52) U.S. Cl.
CPC ..... *B41J 2/155* (2013.01); *B41J 2/14* (2013.01); *B41J 2002/14491* (2013.01); *B41J 2202/20* (2013.01)

(58) Field of Classification Search
CPC ..... B41J 2/155; B41J 2/14; B41J 2002/14491
See application file for complete search history.

(56) References Cited

U.S. PATENT DOCUMENTS 5,016,023 A 5/1991 Chan et al.
5,939,206 A 8/1999 Kneezel et al.
6,328,427 B1 12/2001 Watanabe et al.
(Continued)

FOREIGN PATENT DOCUMENTS

CN 1751885 3/2006
CN 1830668 9/2006
(Continued)

OTHER PUBLICATIONS

International Search Report and Written Opinion issued with respect to application No. PCT/EP2019/069426.
(Continued)

*Primary Examiner* — Jason S Uhlenhake
(74) *Attorney, Agent, or Firm* — Muncy, Geissler, Olds & Lowe, P.C.

(57) ABSTRACT

A multi-chip module (MCM) assembly comprising: a graphite substrate comprising a plurality of silicon chips directly attached to the graphite substrate, and a Printed Wiring Board (PWB) attached to the graphite substrate by means of a solvent-resistant adhesive glue and provided with openings surrounding outer profiles of the silicon chips. A printing bar comprising a plurality of the MCM assemblies is also disclosed.

15 Claims, 5 Drawing Sheets

(56) References Cited

U.S. PATENT DOCUMENTS

| | | | | |
|---|---|---|---|---|
| 2005/0122354 | A1* | 6/2005 | Yamane | B41J 2/04505 347/11 |
| 2006/0077227 | A1 | 4/2006 | Owaki et al. | |
| 2009/0315947 | A1 | 12/2009 | Atsuta | |
| 2010/0013889 | A1* | 1/2010 | Yamamoto | B41J 2/1631 347/44 |
| 2011/0181643 | A1 | 7/2011 | Yamashita | |
| 2011/0310163 | A1* | 12/2011 | Abe | B41J 2/14072 29/890.1 |
| 2012/0007926 | A1 | 1/2012 | Kawamura et al. | |
| 2012/0176451 | A1 | 7/2012 | Iinuma | |
| 2015/0217569 | A1 | 8/2015 | Otaka et al. | |
| 2018/0222201 | A1* | 8/2018 | Cumbie | B41J 2/16 |
| 2019/0300753 | A1* | 10/2019 | Ciampini | C09J 4/06 |

FOREIGN PATENT DOCUMENTS

| | | | |
|---|---|---|---|
| CN | 102310646 | | 1/2012 |
| CN | 102582264 | | 7/2012 |
| JP | 2007-301729 | A | 11/2007 |
| JP | 2007301729 | A * | 11/2007 |
| JP | 2011148249 | | 8/2011 |
| JP | 2011152757 | | 8/2011 |
| JP | 2011152758 | | 8/2011 |
| JP | 2014094570 | | 5/2014 |
| JP | 2017030214 | | 2/2017 |
| JP | 2017154262 | | 9/2017 |
| WO | 2017/198819 | A1 | 11/2017 |
| WO | 2017/198820 | A1 | 11/2017 |

OTHER PUBLICATIONS

International Preliminary Report on Patentability issued with respect to application No. PCT/EP2019/069426.

First Office Action and Search Report issued in corresponding Chinese Application No. 201980050785.4 dated Mar. 28, 2022 (and English language translation of the Office Action).

* cited by examiner

MULTI-CHIP MODULE (MCM) ASSEMBLY AND A PRINTING BAR

TECHNICAL FIELD

The present invention relates to the technical field of a thermal ink printing technology, especially to a wide-page printing technology, and in particular to a multi-chip module assembly and to a printing bar comprising a plurality of multi-chip module assemblies.

BACKGROUND ART

The concept of a multi-chip module (MCM) has been well known for a long time. Technological and economical reasons dissuade the manufacturers from increasing the length of a silicon chip. Accordingly, a longer and more effective print swath can be reasonably obtained only through a plurality of silicon chips, properly disposed onto a rigid substrate and thereby forming the MCM. Shaping the outer profile of a single MCM in a suitable way allows building an even longer printing bar, through the simple juxtaposition of several MCMs.

U.S. Pat. No. 5,016,023 discloses a structure comprising printheads, which are offset with respect to adjacent printheads by an amount at least equal to a width dimension of a printhead. The disclosed structure involves a use of a ceramic material as a substrate suitable for withstanding certain elevated temperatures. However, the manufacturing process of the ceramic substrate is rather expensive, because it requires a specific mold to get the desired shape at once or, alternatively, the use of some hard-tooling equipment to machine such a hard material. Moreover, the set of buss lines and IC packages disclosed in U.S. Pat. No. 5,016,023A are also rather complex and therefore not technologically efficient, reliable and cost-effective.

U.S. 5,939,206 describes an apparatus which comprises at least one semiconductor chip mounted on a substrate, said substrate comprising a porous, electrically conductive member having electrophoretically deposited thereon a coating of a polymeric material, wherein said porous, electrically conductive member comprises graphite or a sintered metal. However, the construction and maintenance of an electrophoretic deposition line is rather expensive that makes the apparatus manufacturing process complex and costly.

It is therefore an object of the present invention to overcome the shortcomings of the prior art and to provide technologically efficient, cost-effective, safe and simple way to realize the electrical contacts, to increase the electrical and mechanical reliability of the multi-chip module assembly, and to ensure high printing quality of the printing equipment using the same.

Another object of the invention is to provide a respective printing bar comprising a plurality of multi-chip module assemblies that ensures achievement of the above-mentioned advantageous effects.

SUMMARY OF THE INVENTION

According to one aspect, the present invention relates to a multi-chip module (MCM) assembly comprising:

a graphite substrate comprising a plurality of silicon chips directly attached to the graphite substrate, wherein the MCM assembly further comprises a Printed Wiring Board (PWB) attached to the graphite substrate by means of a solvent-resistant adhesive glue and provided with openings surrounding outer perimeters of the silicon chips.

The use of a simple PWB provided with openings surrounding the silicon chips of the MCM, provides a simple way to realize the electrical contacts, even if the bonding pads are distributed along opposite sides of the chip. The use of a solvent-resistant adhesive glue enables to seal the two parts preventing the possible ink penetration in between. Moreover, since the adhesive glue is resistant to the solvents, in particular to organic solvents, it renders the multi-chip module suitable for the use with solvent-based inks. The adoption of a solvent-resistant adhesive glue instead of generally used double-side adhesive tape, to bond the PWB to the graphite substrate also allows the accurate adjustment of the level of the PWB surface, during the assembling.

According to a further aspect of the invention, the graphite substrate comprises a protruding rim onto which the silicon chip is mounted. The protruding rim levels the position of the silicon chip thereby achieving a flat printing bar surface and facilitating the hermetic sealing, wiping and capping of the device.

According to a further aspect of the invention, the PWB comprises a recessed portion incorporating bonding pads of the PWB corresponding to bonding pads of the silicon chips. In this way, the maximum elevation of the connection wires realized through the Wire Bonding process with respect to the surfaces of the MCM assembly is reduced, compared with the case where the PWB bonding pads are realized on the PWB top surface. This feature reduces even more the constraint in the minimum distance between the printhead surface and the printing medium, and allows getting closer to the optimum value for the printing quality.

Preferably, the PWB comprises a flexible cable which external portion terminates with a series of contacting pads. This solution enables the MCM assembly to rely on hermetic electrical conductors, whose end part, plugged into an external connector, can be brought far from the portion which is in contact with the ink, through a suitable length of the flexible cable. In this way, the possible detrimental effect of the contact between the ink and the electrical conductors is prevented.

As used herein, the term "flexible" means capable of being bent or flexed (pliable) and further defined as being capable of being bent repeatedly without injury or damage, see The American Heritage® Dictionary of the English Language (4th ed., Boston, Houghton Mifflin, 2000).

In one embodiment, the length of the PWB extends beyond the graphite substrate. Alternatively, it may terminate just before an edge of the graphite substrate. This allows bending the flexible cable so as to keep it close to the edge of the MCM, in a more compact arrangement. In other implementations, the rigid portion of the PWB can terminate at the very edge of the MCM graphite substrate, or the latter can be rounded off, to facilitate the bending of the flexible cable.

According to a further aspect of the invention, the solvent-resistant adhesive glue encompasses both the silicon chips and edges of the openings of the PWB. The silicon chips and the PWB comprise respective bonding pads brought in contact with each other by connecting wires and the solvent-resistant adhesive glue can also encompass said bonding pads and the connecting wires between them. If the PWB comprises a solder resist layer, the solvent-resistant adhesive glue should encompass at least a portion thereof. Incorporating of the solvent-resistant adhesive glue in all these embodiments provides both electrical and mechanical protection.

As used herein, the solvent-resistant adhesive glue can be any suitable adhesive for bonding components having resistance to solvents, preferably, for bonding components of inert material and having resistance to organic solvents, for example, an epoxy-based adhesive, such as, but not limited to, the one disclosed in WO 2017/198820 A1.

According to another aspect of the invention, a printing bar comprises a plurality of MCM assemblies arranged on a support member.

In one embodiment, a printing bar further comprises a cover shield arranged over the plurality of MCM assemblies. The cover shield comprises windows conformal to perimeters of silicon chips of the MCM assemblies, and edges of the windows are sealed with a sealing glue. The cover shield is attached to the PWBs of the plurality of MCM assemblies through an adhesive layer. The use of a cover shield whose windows are sealed with sealing glue is a reasonable solution to prevent ink pooling between contiguous MCMs.

In addition, or alternatively, to prevent ink from penetrating in the space between the MCM assemblies, the MCM assemblies are hermetically sealed by a sealing composition excluding the front surfaces of the MCM assemblies.

According to a further aspect of the invention, the printing bar comprises a sealing block arranged on the support member and composed by a number of metal frames equal to a number of the MCM assemblies. These metal frames surround the MCM assemblies and enclose the sealing composition around the MCM assemblies. The metal frames are joined together with a metal arm. The above-mentioned sealing block provides a barrier for the sealing composition at the outer perimeter of the plurality of the MCM assemblies, strengthening the overall structure and preventing the sealing composition from spreading throughout the surface of the support member. Moreover, the material thickness of the arm occupies partially the gap between adjacent MCM assemblies, reducing even more the amount of the sealing composition, which is necessary to fill up the empty space between the MCM assemblies.

The present invention will be described more fully hereinafter with reference to the accompanying drawings in which same numerals represent same elements throughout the different figures, and in which prominent aspects and features of the invention are illustrated.

DETAILED DESCRIPTION

To increase the swath length in a printhead a possible solution is to align a plurality of silicon chips onto a single substrate, forming a Multi-Chip Module (MCM) to obtain an effective larger printing swath.

The substrate material should be stiff, in order to avoid possible dangerous bending which can damage the silicon chips, and its Coefficient of Thermal Expansion (CTE) should be close to the CTE of silicon, in order to prevent a large stress arising after the assembling. It should be machined easily to provide a flat surface for the chip fixture and all the details for the assembling: ink slots for feeding the ink from the backside, bushing housings for the MCM fixture to an external support, trenches to house the hydraulic glue and so on. Sintered graphite is a suitable material for this purpose: it can fulfill all the mentioned requirements and, moreover, it is cheap. Plates of sintered graphite are available, for example, from TOYO TANSO—Osaka (Japan). A possible drawback of sintered graphite is its porosity, which allows the material to soak the ink, particularly when solvent inks are used. However, implementation of a suitable sealing agent and a chemically compatible glue, such as, but not limited to, the ones disclosed in WO 2017198819 A1 or WO 2017198820 A1, enables to attach the silicon chip to the graphite substrate, after treating with the sealing agent.

According to the present invention, a Printed Wiring Board (PWB) is fixed onto the graphite substrate of the MCM, to provide the electrical connection with the plurality of silicon chips. The silicon chips are assembled onto the graphite substrate, which thermomechanical stability allows maintaining the respective position and alignment of the ejecting elements, whilst the PWB provides the electrical connections with the external controller. If the silicon chips were directly assembled onto the PWB, its poor thermomechanical stability would prevent the stable respective positioning of the ejecting elements, with detrimental effects on the printing quality.

Figure 1:
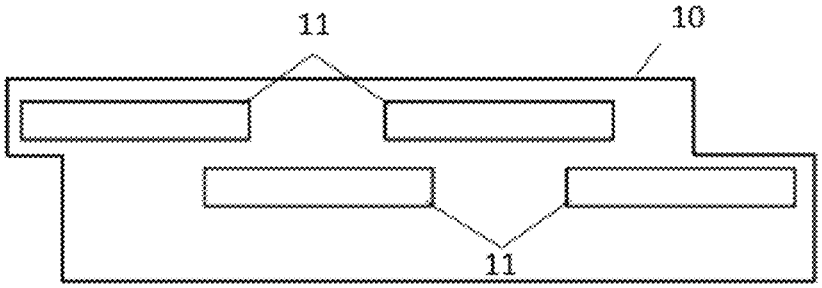
FIG. 1 is a schematic illustration of a Printed Wiring Board (PWB).

As illustrated in FIG. 1, the PWB 10 has suitable openings 11, which leave the surface of the silicon chips exposed, without any obstruction.

Figure 2:
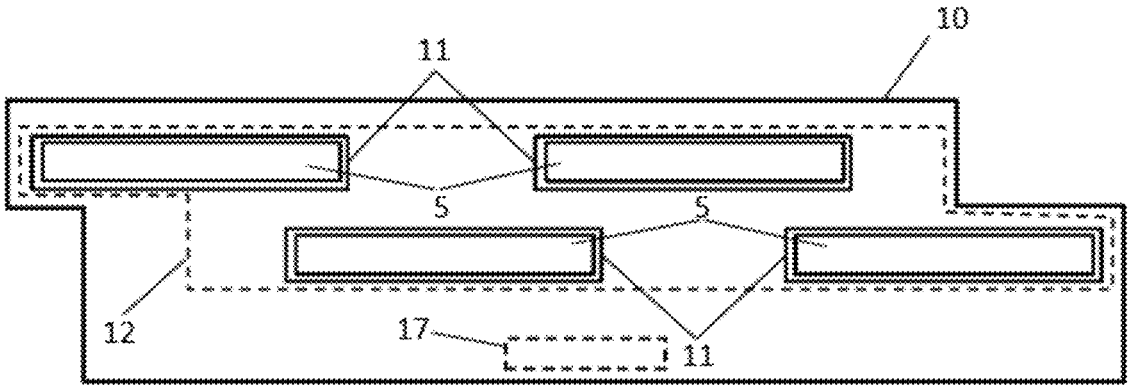
FIG. 2 illustrates a top view of the PWB assembled onto the MCM.

In FIG. 2, depicting the top view of the PWB assembled onto the MCM, the outer profile of the underlying graphite substrate 4 is indicated by the dotted line 12. The MCM outer profile lies entirely in the inner region of the PWB, for sake of clarity, but a different geometry could be adopted, without going away from the basic concept.

Figure 3A:
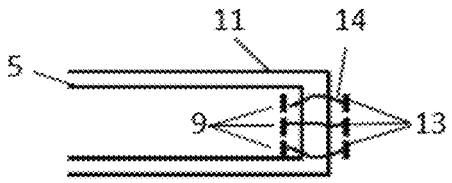
FIG. 3A-B provides a more detailed illustration of the connection of the bonding pads of the silicon chip with corresponding pads of the PWB, in both top view (FIG. 3A) and cross section view (FIG. 3B).

As illustrated in FIGS. 3A (top view) and 3B (cross section view), the bonding pads 9 on the silicon chip are brought in contact with corresponding pads 13 on the PWB, which are placed just beyond the border of the openings, using the Wire Bonding technique, that generates the conductive wires 14 between the two series of pads.

In an embodiment, the top surface of a PWB may be coated by a thin layer of a suitable solder resist (not shown in the drawings), so as to protect both electrically and mechanically the board. In this case, the pads 13 are left uncovered, in order to allow the further bonding of the conductive wires.

The PWB 10 is attached to the graphite substrate 4 through a suitable layer of adhesive glue, able to seal the two parts preventing the possible ink penetration in between. An adhesive glue can be dispensed around the perimeter of each silicon chip, encompassing both the silicon chip and the edge of the PWB opening. Moreover, as mentioned above, the adhesive glue can be selected so as to be resistant to the solvents, in particular to organic solvents, rendering the module suitable for the use with solvent based inks.

Figure 3B:
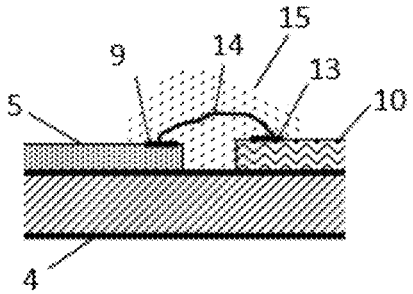

FIG. 3B shows also a further segment of adhesive glue 15, applied after the Wire Bonding in the cavity between the silicon chip 5 and the PWB 10. The adhesive glue incorporates the pads 9 and 13, as well as the connecting wire 14, to give both electrical and mechanical protection. When the solder resist is present, the adhesive glue 15 should be dispensed so as to extend also over a portion of the solder resist layer, beyond the bonding pads.

Figure 4:
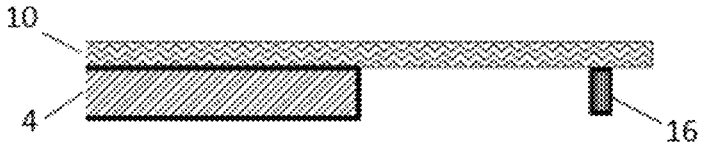
FIG. 4 provides a schematic illustration of the lateral cross section view of the PWB depicted in FIG. 2.

The lateral cross section view of the object depicted in FIG. 2 is schematically shown in FIG. 4. At the bottom surface of the multilayer PWB 10, a rigid connector 16 is attached, so as to bring the electrical signals towards the external controller. In the top view in FIG. 2 the underlying rigid connector 16 is represented by the dotted line 17. The item composed by the MCM graphite substrate 4, that houses the silicon chips, and the PWB 10, connected with the wire bonding to the silicon dice, forms the MCM assembly.

In a printing system a certain number of MCM assemblies are arranged onto a suitable support member, where all the electrical and fluidic connections converge.

Figure 5:
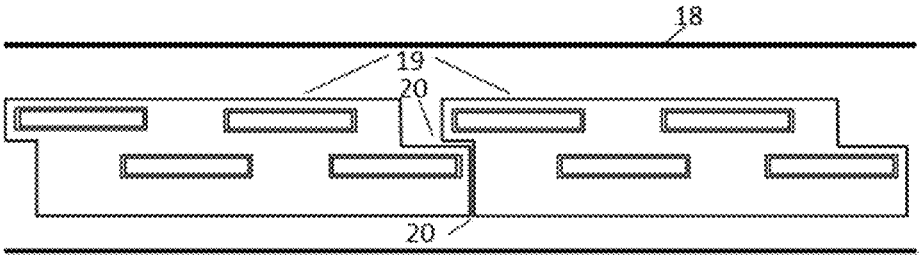
FIG. 5 provides a schematic illustration of the MCM assemblies arranged on a support member.

FIG. 5 illustrates the support member 18 that houses the MCM assemblies 19, and is, in turn, fixed to the framework of the printing equipment. The MCM assemblies are attached to the support member, so that their outer surfaces, where the nozzles are placed, lie on the same plane.

The embodiment illustrated above has been developed especially for the use with water-based inks. In fact, with reference to FIG. 5, during a prolonged printing operation, the possible accumulation of the ink in the region 20, between contiguous MCM assemblies, can cause the liquid stagnation and the consequent risk of ink dripping onto the underlying printing medium. Moreover, the ink pooling could reach the backside of the MCM assemblies, where the rigid electrical connectors are placed, and cause short circuits between different signals.

Figure 6:
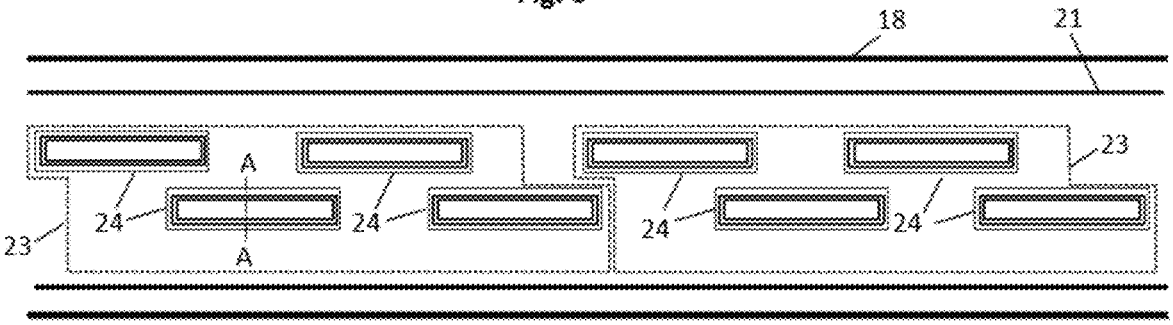
FIG. 6 provides a schematic illustration of the MCM assemblies arranged on a support member and encompassed by a cover shield.
Figure 7A:
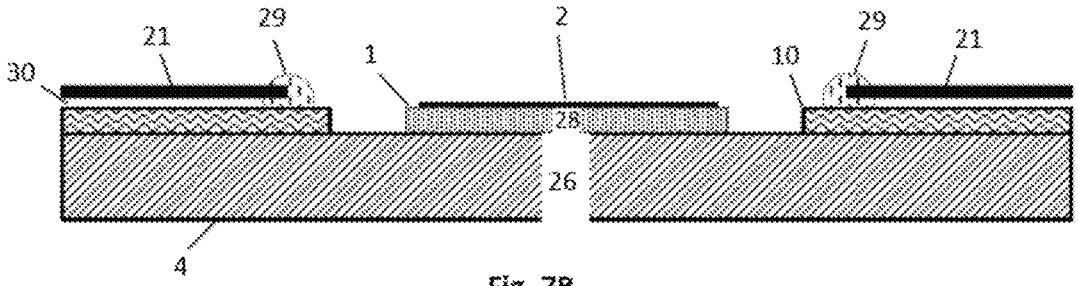
FIG. 7A-B illustrates the cross section along the line A-A of FIG. 6, with the cover shield being separated from the PWB surface by a small space (FIG. 7A) or brought in contact with the PWB and attached through an adhesive layer (FIG. 7B).
Figure 7B:
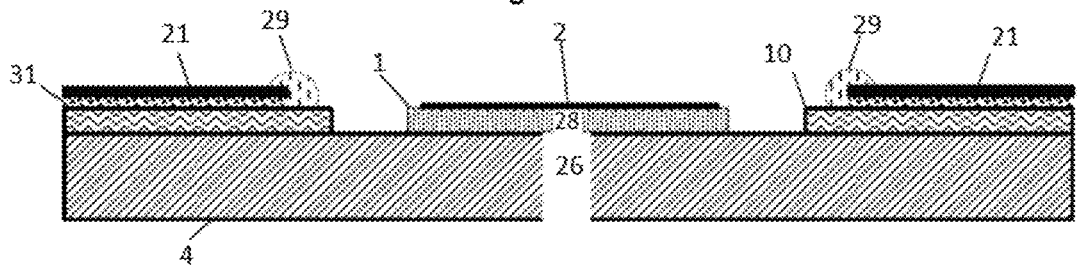

As illustrated in FIG. 6, one solution is to apply a cover shield 21, provided with suitable windows 24 conformal to perimeters of silicon chips of the MCM assemblies. The border of the cover shield windows 24 should be sealed with a sealing glue, which gets in contact also with the PWB surface. The dotted line 23 corresponds to the underlying MCM assemblies, whilst the sealing glue 29 is illustrated in FIG. 7, where a cross-section along the line A-A of FIG. 6 is displayed. The cover shield can either be separated by the PWB surface by a small space 30 (FIG. 7A) or it can be brought in contact with the PWB and attached through an adhesive layer 31 either throughout the whole surface or in selected regions (FIG. 7B). FIG. 7 also shows the ink feeding slot 26 of the graphite substrate 4 and the corresponding ink feeding slot 28 in the silicon chip, which are in fluidic communication with each other.

Figure 8:
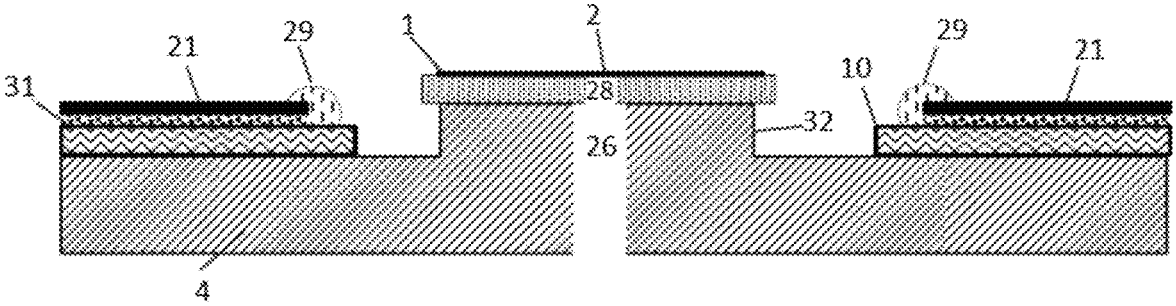
FIG. 8 illustrates the MCM assembly with the graphite support having a protruding rim.

As illustrated in FIG. 8, the graphite substrate 4 is shaped in such a way that a protruding rim 32, which surrounds the ink feeding slot 26, is used as a base onto which the silicon chip is applied. Since the level of the printhead surface can be rendered higher than the surface of the cover shield, the former can be positioned at the optimum distance with respect to the printing medium, without any encumbrance to the cover shield. Since graphite is easy to machine with mechanical tool, the protruding rim can be obtained with a quick and cheap process.

Figure 9A:
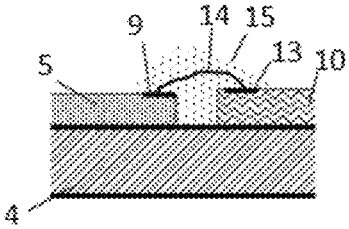
FIG. 9A-B illustrates arrangement of the PWB without the recessed region (FIG. 9A) and with the recessed region (FIG. 9B).

As shown in the cross section view of FIG. 9, the multilayer PWB is realized in such a way that the PWB bonding pads, corresponding to the ones present on the silicon chip surface, can be realized on a recessed portion of the PWB surface. In this way, the maximum elevation of the connection wires realized through the Wire Bonding process with respect to the surfaces of the MCM assembly is reduced, compared with the case where the PWB bonding pads are realized at the top of the PWB surface.

Figure 9B:
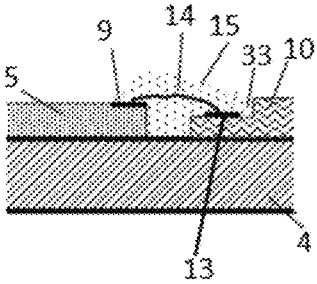

FIG. 9B illustrates the PWB 10 with the bonding pads 13 placed onto the recessed region 33. The wire 14 and the sealing glue 15 reach a maximum elevation level which is lower than in FIG. 9A, where the recessed region 33 is not present and the bonding pads 13 lie on the top of the PWB surface. This feature reduces even more the constraint in the minimum distance between the printhead surface and the printing medium, and allows getting closer to the optimum value for the printing quality.

The adoption of suitable amount of adhesive glue to bond the PWB 10 to the graphite substrate 4, as mentioned above, allows the accurate adjustment of the level of the PWB surface, during the assembling.

Figure 10:
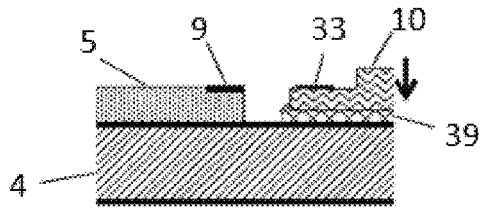
FIG. 10 illustrates arrangement of the PWB against the graphite substrate.

As shown in FIG. 10, since the adhesive glue 39 has a certain degree of softness before curing, the PWB 10 can be placed against the graphite substrate with a controlled penetration in the adhesive glue 39 material, following the arrow, so as to set accurately the level of its surface to the desired position.

In a further embodiment, described in the cross section of FIG. 11, the PWB 10 is made so as to have a flexible cable 34 embedded in the rigid PWB structure, in electrical communication with the PWB bonding pads, whose external portion expands for a certain length out of the rigid structure of the PWB, terminating in turn with a series of contacting pads 35, that can be plugged into an external socket 36, which is connected to the printing equipment controller. This solution eliminates the connector 16 of FIG. 4, allowing the MCM assembly to rely on hermetic electrical conductors, whose end part, plugged into an external connector, can be brought far from the portion which is in contact with the ink, through a suitable length of the flexible cable extension. In this way the possible detrimental effect of the contact between the ink and the electrical conductors is prevented.

Figure 11A:
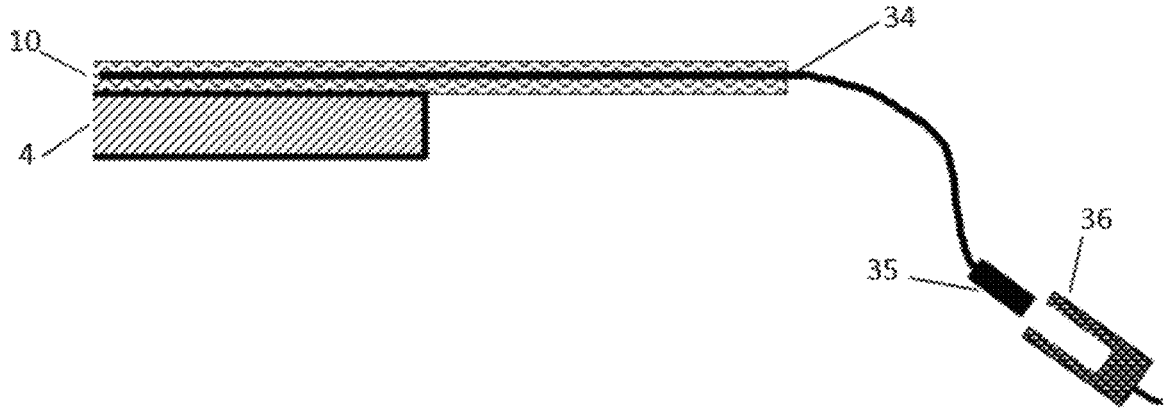
FIG. 11A-B illustrates the PWB with embedded flexible cable, where the PWB extends beyond the graphite substrate (FIG. 11A) and where the rigid portion of the PWB terminates just before the edge of the graphite substrate (FIG. 11B).
Figure 11B:
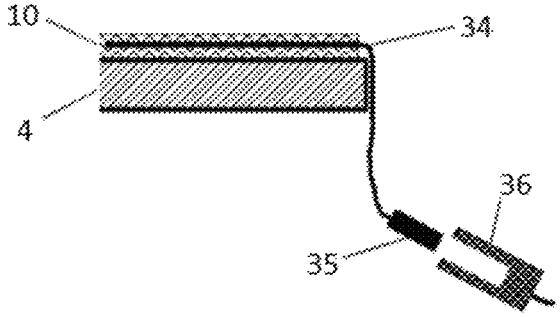

FIG. 11A illustrates an implementation where the PWB 10 extends beyond the graphite substrate 4. FIG. 11B illustrates an alternative implementation, where the rigid portion of the PWB 10 terminates just before the edge of the graphite substrate 4. This allows bending the flexible cable 34 so as to keep it close to the edge of the graphite substrate 4, in a more compact arrangement. In other implementations, the rigid portion of the PWB 10 can terminate at the very edge of the graphite substrate 4, or the latter can be rounded off, to facilitate the bending of the flexible cable 35.

Figure 12:
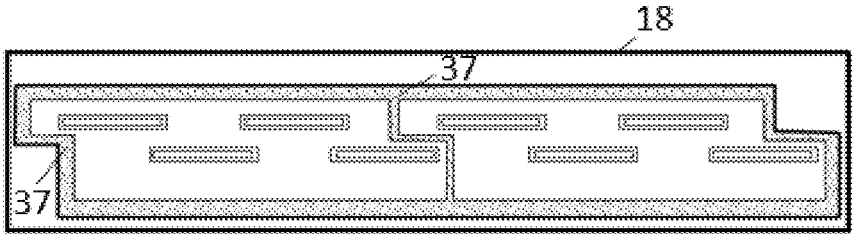
FIG. 12 illustrates an embodiment using a sealing composition surrounding the plurality of the MCM assemblies.

In a further embodiment, the cover shield 21 which encompasses all the MCM assemblies placed onto the support member 18, as illustrated in FIG. 6, can be eliminated. To prevent ink from penetrating in the space 20 between the MCM assemblies, as shown in FIG. 5, a suitable sealing composition can be poured in the space 20 and in the region surrounding the plurality of the MCM assemblies, as shown in FIG. 12. The MCM assemblies are hermetically sealed by the sealing composition 37, leaving unobstructed the front surfaces for printing. For this purpose, the outer profile of both the graphite substrate and the PWB should be adjusted so as to leave a smaller and possibly uniform distance between adjacent MCM assemblies, in order to minimize the amount of the sealing composition necessary to provide the hermeticity to the whole structure.

Figure 13:
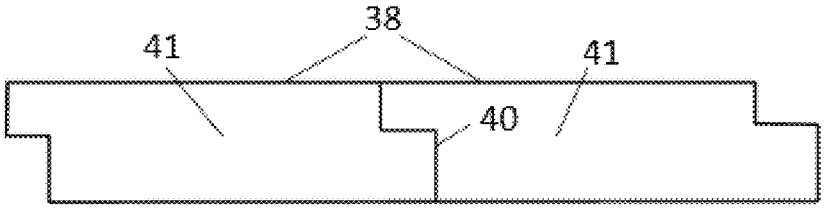
FIG. 13 schematically illustrates a sealing block.

FIG. 13 schematically illustrates a sealing block 38. It constitutes a metal structure, which is fastened to the support member 18 and is shaped so as to surround the MCM assemblies. It is composed by a number of frames equal to the number of MCM assemblies placed onto the support member 18. The frames consist only of the outer profile and are completely devoid of material in the inner region 41, in order to be able to house internally the plurality of MCM assemblies. The frames which are related to adjacent MCM assemblies are joined together with the metal arm 40, so that the totality of the frames form together the one-piece sealing block 40. After the insertion between the MCM assemblies and the fastening to the support member 18, the sealing block 38 provides a barrier for the sealing composition at the outer perimeter of the plurality of the MCM assemblies, strengthening the overall structure and preventing the sealing composition from spreading throughout the surface of the support member 18. Moreover, the material thickness of the arm 40 occupies partially the gap between adjacent modules, reducing even more the amount of the sealing composition, which is necessary to fill up all the empty space.

Figure 14:
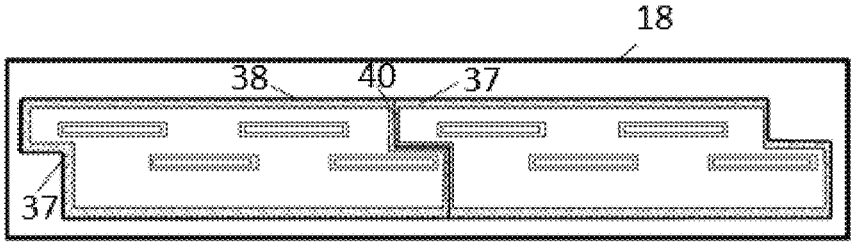
FIG. 14 illustrates an embodiment using the sealing block assembled to the support member.

FIG. 14 illustrates the sealing block 38 assembled to the support member 18. The sealing block 38 surrounds the MCM assemblies and penetrates into the space between adjacent modules. The sealing composition 37 remains enclosed in the internal region of the sealing block, filling all the available space. For sake of simplicity, a support member comprising only two MCM assemblies is shown, but the concept can be obviously extended to any number of modules assemblies and even to a single module assembly.

Some of the described embodiments can be used alternatively, according to the convenience with respect to the operating conditions, whilst some other embodiments can be joined together to get an extremely performing printing equipment, as can be easily understood by those skilled in the art. As an example, the protruding rim 32, the bonding pads 13 placed in a recessed region 33 of the PWB 10, the embedded flexible cable 34, the sealing composition 37 and the sealing block 38 can be used together in an actual realization. The PWB 10 can be attached to the graphite substrate 4 through the adhesive glue 39 and the level of its top surface can be adjusted so as to be equal to the level of the top surface of the printheads, thereby forming a long swath printing system with high printing quality and reliability.

The proposed solution for the multi-chip module assembly and respective printing bar according to the invention turns out to be simple and cost-effective.

Compared with other known multi-chip module assemblies, the present invention provides technologically efficient, cost-effective, safe and simple way to realize the electrical contacts, to increase the electrical and mechanical reliability of the multi-chip module assembly and ensure high printing quality of the printing equipment using the same.

The above disclosed subject matter is to be considered illustrative, and not restrictive, and serves to provide a better understanding of the inventions defined by the independent claims.

The invention claimed is:

1. A multi-chip module (MCM) assembly comprising:

a graphite substrate comprising a plurality of silicon chips directly attached to the graphite substrate, wherein the MCM assembly further comprises a Printed Wiring Board (PWB) attached to the graphite substrate by means of a solvent-resistant adhesive glue and provided with openings surrounding outer perimeters of the silicon chips, wherein the graphite substrate comprises a protruding rim onto which the silicon chip is mounted, wherein the PWB comprises a recessed region, and wherein at least one bonding pad of the PWB, corresponding to bonding pads of the silicon chips, is placed onto said recessed region.

2. The assembly according to claim 1, wherein the PWB comprises a recessed portion incorporating bonding pads of the PWB corresponding to bonding pads of the silicon chips.

3. The assembly according to claim 1, wherein the PWB comprises a flexible cable which external portion terminates with a series of contacting pads.

4. The assembly according to claim 3, wherein the length of the PWB extends beyond the graphite substrate or terminates just before an edge of the graphite substrate.

5. The assembly according to claim 1, wherein the solvent-resistant adhesive glue encompasses both the silicon chips and edges of the openings of the PWB.

6. The assembly according to claim 1, wherein the silicon chips and the PWB comprise respective bonding pads brought in contact with each other by connecting wires and the solvent-resistant adhesive glue encompasses said bonding pads and the connecting wires between them.

7. The assembly according to claim 1, wherein the PWB comprises a solder resist layer and the solvent-resistant adhesive glue encompasses at least a portion of the solder resist layer.

8. The assembly according to claim 1, wherein the solvent-resistant adhesive glue is an epoxy-based adhesive.

9. A printing bar comprising a plurality of MCM assemblies recited in claim 1 arranged on a support member.

10. The printing bar according to claim 9, further comprising a cover shield arranged over the plurality of MCM assemblies.

11. The printing bar according to claim 10, wherein the cover shield comprises windows conformal to perimeters of silicon chips of the MCM assemblies, and edges of the windows are sealed with a sealing glue.

12. The printing bar according to claim 10, wherein the cover shield is attached to the PWBs of the plurality of MCM assemblies through an adhesive layer.

13. The printing bar according to claim 9, wherein the MCM assemblies are hermetically sealed by a sealing composition (37) excluding front surfaces of the MCM assemblies.

14. The printing bar according to claim 13, further comprising a sealing block arranged on the support member and composed by a number of metal frames equal to a number of the MCM assemblies, the metal frames surrounding the MCM assemblies and enclosing the sealing composition around the MCM assemblies.

15. The printing bar according to claim 14, wherein the metal frames surrounding adjacent MCM assemblies are joined together with a metal arm.

* * * * *